US005168660A

United States Patent [19]

Smith

[11] Patent Number: 5,168,660

[45] Date of Patent: Dec. 8, 1992

[54] TUBING ABRASIVE CLEANING DEVICE

[76] Inventor: Raymond A. Smith, 2267 Brookside Dr., Martinsville, N.J. 08836

[21] Appl. No.: 897,490

[22] Filed: Jun. 12, 1992

[51] Int. Cl.[5] ..... B24B 9/00; B08B 9/00

[52] U.S. Cl. ..... 51/181 NT; 51/290; 51/354; 15/104.04; 15/104.05

[58] Field of Search ..... 51/181 R, 181 NT, 290, 51/73 R, 73 GC, 354, 170 PT; 7/157; 15/104.02, 104.03, 104.04, 104.05, 104.09, 111, 88

[56] References Cited

U.S. PATENT DOCUMENTS

| | | | |
|---|---|---|---|
| 2,225,272 | 12/1940 | Horne | 15/88 |
| 2,404,507 | 7/1946 | Link | 15/104.011 |
| 2,551,875 | 5/1951 | Cotton | 15/105 |
| 3,188,674 | 6/1965 | Hobbs | 15/179 |
| 4,104,937 | 8/1978 | Breaux | 15/88 |
| 4,133,070 | 1/1979 | Litt | 15/106 |
| 4,238,867 | 12/1980 | Ruggero | 15/88 |
| 4,372,003 | 2/1983 | Toelke | 15/104.04 |
| 4,403,363 | 9/1983 | Hess | 15/104.05 |
| 4,433,448 | 2/1984 | True | 15/88 |
| 4,467,489 | 8/1984 | Begneaud | 15/88 |
| 4,862,549 | 9/1989 | Criswell | 15/104.04 |
| 5,005,244 | 4/1991 | Muraguchi | 15/104.04 |

*Primary Examiner*—Bruce M. Kisliuk
*Assistant Examiner*—Bryan Reichenbach
*Attorney, Agent, or Firm*—Kenneth P. Glynn

[57] ABSTRACT

The present invention relates to an abrasive cleaning device for tubing useful for brushing and reaming, which comprises: (a) an axial shaft adapted to be attached to a power tool chuck and having a central longitudinal axis; (b) a generally flat rear wall attached to the shaft; (c) at least two working members, each of the working members having two walls, a first wall and a second wall and having an angle of at least 45° between the first wall and the second wall, the first wall having a tubing reaming blade thereon; and the second wall having thereon abrasive for abrading tubing; (d) hinges connected to the rear wall and to the working members such that the working members are hingedly connected to the rear wall and have a first position and a second position relative to the rear wall, the second position being such that the second wall is hinged outwardly by at least about 20° away from the central longitudinal axis and so as to place the first wall of the device in a reaming mode, the first position being such that the second wall would be parallel to the central longitudinal axis so as to place the device in a brushing mode.

15 Claims, 3 Drawing Sheets

TUBING ABRASIVE CLEANING DEVICE

BACKGROUND OF THE INVENTION

1. Field of the Invention

The present invention relates generally to devices for preparing piping and tubing for subsequent soldering or welding operations, and, more particularly, to a device for cleaning the outside of the end of a pipe as well as reaming out and cleaning the inside of the same end of a pipe using a rotary abrasion tool.

2. Prior Art Statement

It is well-known that a plumber or pipe fitter who wishes to join pieces of tubing or piping must first prepare the inner surface of the piece having the wider diameter as well as the outer surface of the piece to be soldered or brazed thereon. The preparation of the surfaces typically involves abrading the surfaces to be joined with an abrasive means such as sandpaper or wire bristle brushes.

Additionally, it is well-known that when a pipe is cut with a pipe cutter, the diameter of the pipe at the very end may be decreased somewhat and there may be excess material left on the inner edge of the cut site. Therefore, among the preparations prior to the soldering or brazing operation, there are included the requirements that the cut end of the pipe be restored to its full diameter and that any excess material or burrs along the inner diameter of the cut must be scraped away. In the past, the scraping and widening operations have been accomplished by the separate step of reaming the cut end on its inner surface with a reaming tool.

U.S. Pat. No. 4,862,549 to Criswell et al. is directed to an attachment consisting of an internal brush for cleaning of fittings and an external brush for cleaning of tubes or pipes prior to soldering or brazing which are provided in a single attachment which may be driven by either a manual or motor driven means.

U.S. Pat. No. 4,238,867 to Ruggero, et al. discloses a motor-driven abrading tool for cleaning outer and inner surfaces of ends of pieces of copper tubing, wherein a single motor drives a longitudinally-mounted shaft. A male abrasive member such as a wire brush is secured to one end of the shaft and a female abrasive member is secured to the opposite end of the shaft.

U.S. Pat. No. 4,133,070 to Litt discloses a manually-operated tool for scarifying the end areas of cylindrical members such as pipes or rods. The tool comprises a body member which is provided on its exterior with at least one wire brush extending therefrom. The body member is further provided with a hole therethrough that is lined with scarifying material and through which a cylindrical member may be passed, thus having its outer surface scarified.

U.S. Pat. No. 3,188,674 to Hobbs discloses a rotary tube end cleaner which is essentially a socket or cylindrical housing having a cylindrical inner surface which is lined with an abrasive material such as wire bristles, sandpaper and the like. The socket can be mounted to an electric drill and is provided with adjustment screws for changing the distance between the oppositely facing abrasive surfaces, thereby permitting adjustment for varying diameters of piping.

U.S. Pat. Nos. 2,404,507 to Link, 4,433,448 to True and 4,467,489 to Begneaud all are related to brush devices either manually operated or motor driven for cleaning the threads of bolts and studs and threaded pipe ends using combinations of bristles and solvent or air application.

None of the patents discussed above provides means for reaming the end of a cut pipe and the removal of excess material therefrom. It is contemplated that, in all of the prior art devices, the step of reaming and burr or excess material removal is viewed as an operation which is performed prior to the application of the prior art devices for abrasively cleaning the inner and outer surfaces of the pipes or fittings to be welded or brazed. None of the prior art devices teach or render obvious the device of the present invention wherein the insertion of a pipe end into a single tool and operation thereof accomplishes reaming the cut end of the pipe, removing excess material therefrom, and abrasively cleaning the inner and/or outer surfaces thereof.

SUMMARY OF THE INVENTION

The present invention is directed to an abrasive cleaning device useful for brushing and reaming tubing, comprising an axial shaft which is adapted to be attached to a power tool chuck. A generally flat rear wall is radially attached to the axial shaft and two or more working members are attached by hinges to the rear wall. Each of the working members has two walls, a first wall with a reaming blade and a second wall with an abrasive brush. The working members are generally biased into a reaming position relative to the rear wall. The working members are moved into a brushing position by the insertion of a work piece fully into the device. Therefore, reaming of the cut end and cleaning of the outer tubing surface are made possible with a single insertion and removal of a cut end of tubing into the device while the device is rotated by a suitable motor means such as a drill or mounted motor.

BRIEF DESCRIPTION OF THE DRAWINGS

The present invention is more fully understood when this specification is taken in conjunction with the drawings which are appended hereto, and wherein.

DETAILED DESCRIPTION OF THE PRESENT INVENTION

Figure 1:
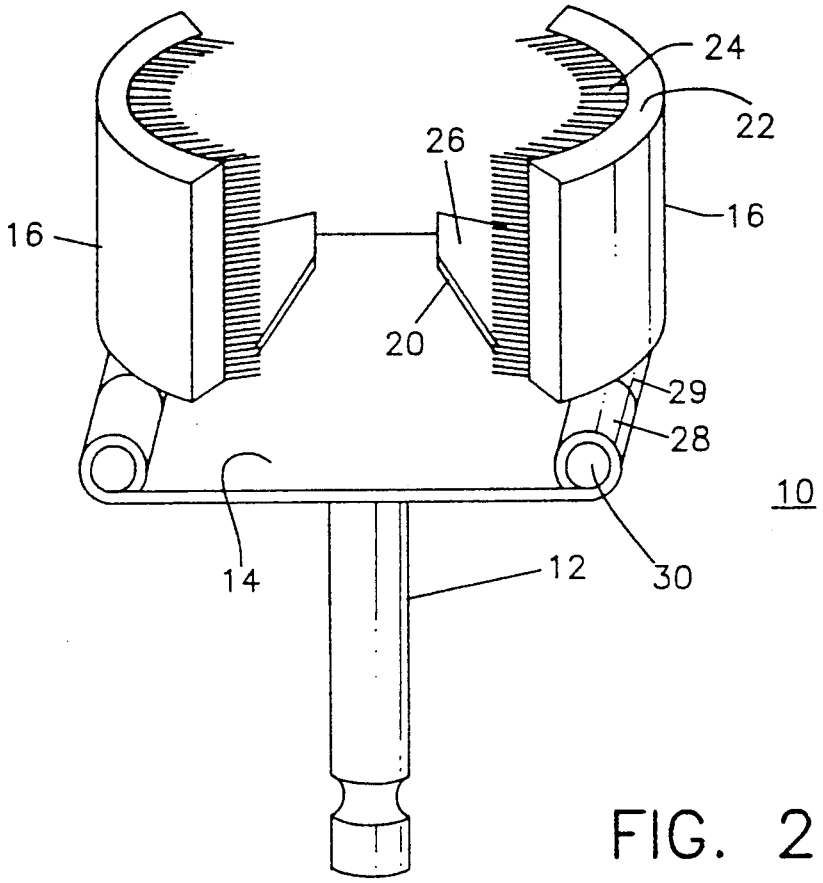
FIG. 1 is a perspective view of a tubing abrasive cleaning device shown in a brushing mode position.

The general operation for "sweating" or soldering pipes and tubing together begins with the process of cutting a pipe to length. Commonly used pipe cutters comprise a device shaped like a C-clamp having a cutting wheel at one end of the "C" and bearings at the other end of the "C". The "C" is applied to the pipe and positioned and tightened so that the cutting wheel and the bearings come into contact with the outer surface of the pipe. The clamp is then turned around the pipe and the C-clamp is increasingly tightened, cutting deeper with each turn of the clamp into the piping until the piping is eventually cut where the cutting wheel made contact.

The cutting operation has two undesirable effects on the newly revealed pipe end. Those undesirable effects include the creation of metal burrs along the inner surface at the cut edge of the pipe as well as slightly decreasing the diameter of the pipe at the cut edge. These two physical changes, if left uncorrected, can affect the flow of whatever fluid is intended to be passed through the finished system. Additionally, burrs which are not removed can break off and foul machinery and apparatus which are incorporated into the finished system, such as pumps and sensors.

Commonly, a plumber or pipe fitter will, after the pipe has been cut to length, use a reamer to cut away burrs from the cut edge and to widen the mouth of the pipe opening back to its original diameter. Then, either the outer surface or inner surface near the cut edge of the pipe is cleaned, usually by abrasion, until it is provided with a shiny, brushed appearance. At this stage of the operation, the artisan would apply flux or a similar solder-drawing compound onto the cleaned portions of tubing to be soldered and push one into the other. The artisan then applies heat and solder and allows the workpiece to cool, thereby allowing the drawn-in solder to harden and form a fluid tight joint.

The present invention is directed to an abrasive cleaning device useful for brushing and reaming tubing, comprising an axial shaft which is adapted to be attached to a power tool chuck. A generally flat rear wall is radially attached to the axial shaft and at least two working members are attached by hinges to the rear wall. Each of the working members has two walls, a first wall and a second wall with an angle of at least 45 degrees between the first and the second walls, whereon the first wall has a reaming blade and the second wall has abrasive means. The abrasive means may be a brush made up of wire bristles or a particulate impregnated surface. The working members are biased into a reaming mode position relative to the rear wall such that the second wall extends outwardly at least 20° away from an imaginary extension of the axial shaft thereby placing the device into a reaming mode. The working members are moved into a brushing mode position relative to the rear wall by the insertion of a work piece fully into the device so that the second wall is parallel to the imaginary extension of the axial shaft and the first wall is nesting on the rear wall, thereby placing the device in a brushing mode. Therefore, reaming of the cut end, removal of any excess material, and cleaning of the outer tubing surface are made possible with a single insertion and removal of a cut end of tubing into the device while the device is rotated by a suitable motor means such as a drill or mounted motor.

In a preferred embodiment of the present invention the second wall of each working member is arcuated to conform to a predetermined radius and replacement of the working members with substitute working members of the same or different sizes is made possible by providing hinges adapted to be disconnected.

In an alternate embodiment of the device the connecting hinges may be permanently pinned and different sized brush/reamers (working members) may be releasably attached thereto.

In another alternative embodiment of the present invention, the abrasive cleaning device useful for brushing and reaming the end and exterior surface of tubing is attached to an axial shaft and a second axial shaft is provided with a male abrasive means at one end thereof. The first and second axial shafts are connected to a single motor by selection means which are adapted for allowing a user to optionally select between driving one shaft or the other.

Alternatively, a single shaft could be provided with an abrasive cleaning device useful for brushing and reaming tubing on one end and having a male abrasive means on the other end and being provided near the center of the shaft with means by which a single motor will drive the entire shaft thereby rotating both ends of the tool.

Referring now to FIG. 1, there is illustrated a tubing abrasive cleaning device 10 shown in a brushing mode which is achieved by insertion of work piece (not shown) fully into the device. Cleaning device 10 comprises an axial shaft 12 which is adapted to be attached to a power tool chuck such as that of a power drill. The cleaning device 10 has a generally flat rear wall 14 radially attached to shaft 12, said rear wall having at least two working members 16 extending outwardly therefrom. Each one of working members 16 is hingedly attached to rear wall 14 as shown. Front hinge section 28 and corresponding rear hinge section (not shown) are formed from extending upturned portions of rear wall 14 itself. Middle hinge section 29 is connected to working member 16 by any number of conventional means, for example, by spot welding. Removable pin 30 is inserted through hinged sections as shown. Each one of working members 16 has first wall 20 and second wall 22 between which there is an angle of at least 45°. Second wall 22 is provided with an abrasive brush 24 on the surface facing first wall 20 and first wall 20 is provided with a tubing reaming blade 26 on the surface facing second wall 22.

Figure 2:
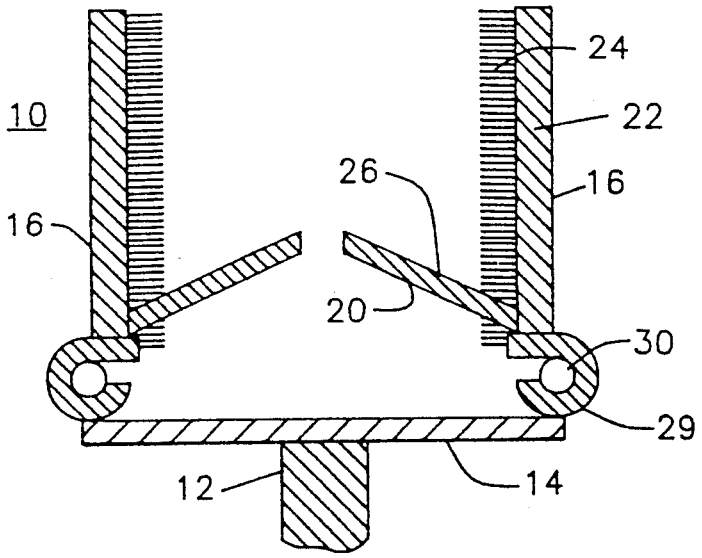
FIG. 2 is a side cut view of the tubing abrasive cleaning device illustrated in FIG. 1 shown in a brushing mode position.

FIG. 2 shows a side cut view of cleaning device 10 of FIG. 1, also in a brushing position (like parts being like numbered). Again, it is pointed out that this brushing position is achieved by inserting a work piece (not shown) and pushing it as far as possible into the device. Working members 16 are shown hingedly attached to rear wall 14 as typified by middle hinge section 29 with removable pins as typified by removable pin 30. Middle hinge section 29 may be, for example, spot welded to the bottom of working member 16. However, any number of conventional means of hingedly connecting the working member to the rear wall are possible within the scope of the present invention. In the brushing position second wall 22 is parallel to the central longitudinal axis of axial shaft 12 and first wall 20 is nested near rear wall 14. In the brushing position, brushes 24 come in contact with the outer surface of work piece tubing (not shown) and when axial shaft 12 is connected to a power tool chuck such as that of a power drill and the tool is turned on, brushes 24 rotate, cleaning and abrading the outer surface of work piece tubing (not shown). In this brushing position, first wall 20 with tubing reaming blade 26 does not come in contact with the inner surface of the work piece tubing.

Figure 3:
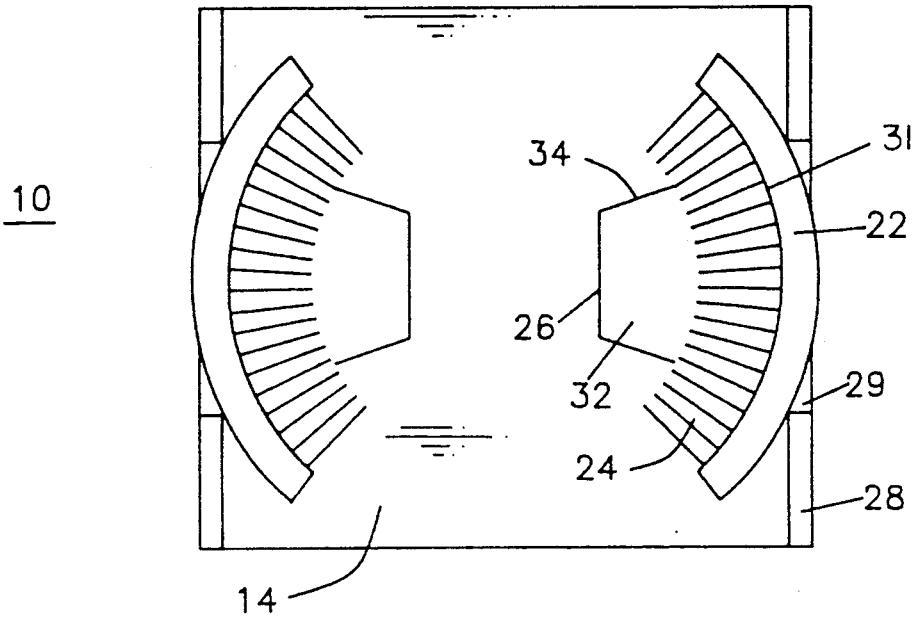
FIG. 3 is a top view of the tubing abrasive cleaning device illustrated in FIGS. 1 and 2.

FIG. 3 shows a top plan view of the device 10 shown in FIGS. 1 and 2. Like parts are like numbered. It can be seen that second wall 22 is provided with arcuate inner surface 31 having a radius which is predetermined according to the diameter of pipe with which device 10 is intended to be used. It can be seen tubing reaming blades 26 could have any number of desirable conformations, for example, as can be seen in FIGS. 1-3, blades 26 can have a frusto-triangular profile wherein each blade has an upper side 32 which is provided with a knife-edge 34 sufficient for clipping away burrs from within the cut edge of a work piece.

With reference to FIGS. 2 and 3 it is contemplated that working members 16 can be disconnected and replaced with working members having outer walls with similar or different radii as needed by the particular job at hand. The removability of working members 16 can be accomplished by any number of conventional means, for example, by providing hinges with removable pins as shown (typified by hinge sections 28 and 29 and removable pin 30) which may be electively removed and replaced as desired.

Figure 4:
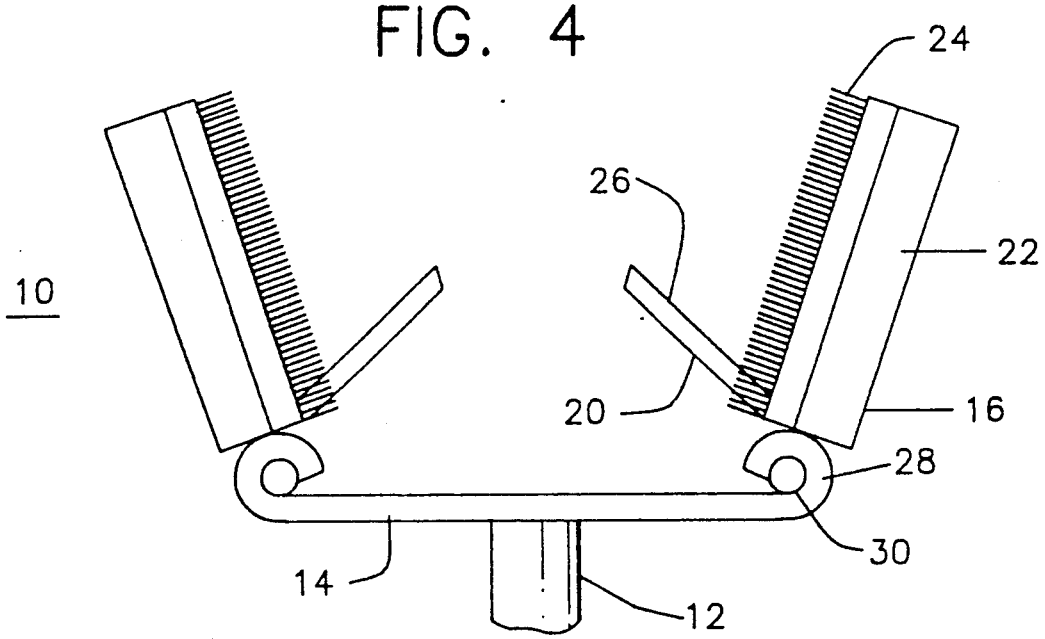
FIG. 4 is a side view of the tubing abrasive cleaning device illustrated in FIGS. 1-3 shown in a reaming mode position.

FIG. 4 shows a side view of the device 10 of FIGS. 1-3 in a biased reaming mode position. Like parts are like numbered. When a work piece is not pushed fully down into the present invention device, working members 16 are typically biased into the reaming mode position shown in FIG. 4 by biasing means provided in or about hinge sections (typified by front hinge section 28) such as a conventional spring or other resilient biasing means for returnably holding working members 16 in a biased reaming mode position. In this reaming mode position, second wall 22 extends outwardly away from the longitudinal axis of axial shaft 12 by at least an angle of about 20°, thereby placing first wall 20 with reaming blade 26 in contact with the inner surface of a cut end of pipe (not shown) to be reamed. When axial shaft 12 is rotated by means of a power tool, the inner surface of a cut end of pipe can be reamed and loose burrs cut away. Alternatively, rather than biasing means such as springs being used to hold working members 16 in a biased reaming mode position, centrifugal force resulting from the spinning of axial shaft 12 when the device is in operation, may hold working members in a biased reaming mode position.

Figure 5:
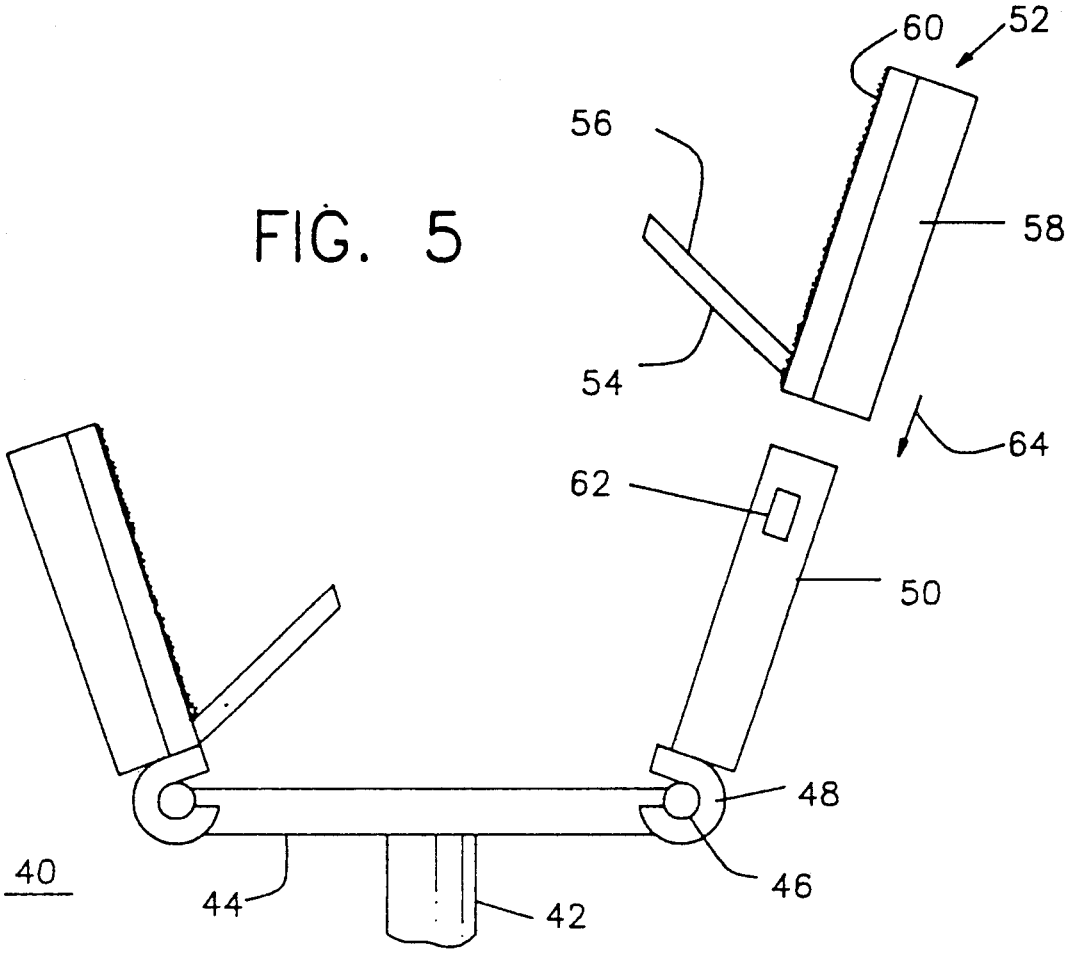
FIG. 5 is a side view of an alternative embodiment of the present invention device; and, FIG. 6 is a top view of an alternative embodiment of the present invention.

FIG. 5 shows an alternative embodiment device 40 of the present invention showing axial shaft 42 with rear wall 44. Working arm 50 is attached to rear wall 44 by means of separate hinge 48 and permanent pin 46. The attachment of separate hinge 48 to the working member and the rear wall can be accomplished by any number of conventional means, for example, by spot welding. In this embodiment, alternate working member 52 is releasably attached as shown by arrow 64 to connecting arm 50 by means of clip 62. Alternate working member 52 consists of first wall 54 with reaming blade 56 thereon and second wall 58 with abrasive particulate impregnated surface 60 facing first wall 54. Abrasive particulate impregnated surface 60 is used in place of brushes for cleaning and abrading the outer surface of a cut end of pipe in this embodiment. Alternate working member 52 may be removed from connecting arm 50 and replaced by different sized alternate working members as needed.

Figure 6:
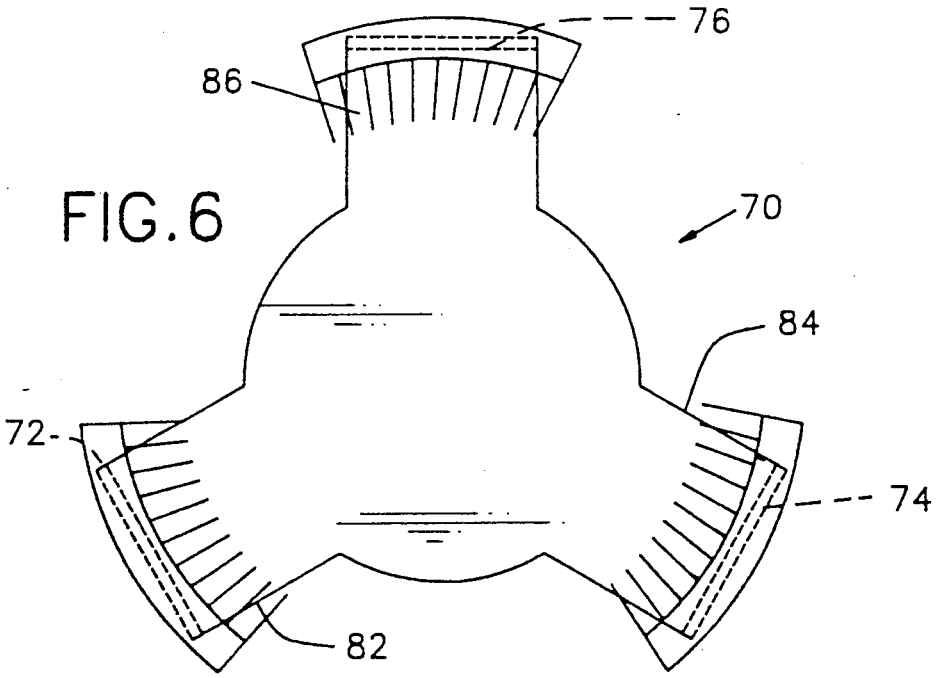

The rear walls of various tubing abrasive cleaning devices may be different sizes or even different shapes depending upon the job at hand. For example, FIG. 6 shows a top plan view of an alternative configuration of a rear wall 70 for a wherein working members 82, 84 and 86 are attached to rear wall 70 by hinges 72, 74 and 76.

Obviously, numerous modifications and variations of the present invention are possible in light of the above teachings. It is therefore understood that within the scope of the appended claims, the invention may be practiced otherwise than as specifically described herein.

What is claimed is:

1. An abrasive cleaning device for tubing useful for brushing and reaming, which comprises:

(a) an axial shaft adapted to be attached to a power tool chuck and having a central longitudinal axis;

(b) a generally flat rear wall attached to said shaft;

(c) at least two working members, each of said working members having two walls, a first wall and a second wall and having an angle of at least 45° between said first wall and said second wall, said first wall having a tubing reaming blade thereon and said second wall having thereon abrasive means for abrading tubing; and, (d) hinges connected to said rear wall and to said working members such that said working members are hingedly connected to said rear wall and have a brushing mode position and a reaming mode position relative to said rear wall, said reaming mode position being such that said second wall is hinged outwardly by at least about 20° away from said central longitudinal axis and so as to place the device in a reaming mode, said brushing mode position being such that the second wall would be parallel to said central longitudinal axis and so as to place the device in a brushing mode.

2. The abrasive cleaning device of claim 1 wherein said second wall is arcuated to conform to a predetermined radius.

3. The abrasive cleaning device of claim 1 wherein said hinges are biased to returnably hold said working members in said reaming mode position.

4. The abrasive cleaning device of claim 2 wherein said hinges are biased to returnably hold said working members in said reaming mode position.

5. The abrasive cleaning device of claim 1 wherein said working members are held in a reaming position by means of centrifugal force.

6. The abrasive cleaning device of claim 2 wherein said working members are held in a reaming position by means of centrifugal force.

7. The abrasive cleaning device of claim 1 wherein said hinges contain removable pins so as to render said working members removable for replacement with substitute working members of different sizes.

8. The abrasive cleaning device of claim 3 wherein said hinges contain removable pins so as to render said working members removable for replacement with substitute working members of different sizes.

9. The abrasive cleaning device of claim 5 wherein said hinges contain removable pins so as to render said working members removable for replacement with substitute working members of different sizes.

10. The abrasive cleaning device of claim 1 wherein said hinges are permanently pinned and connecting arms with clips are attached to said hinges so as to render said working members removable for replacement with substitute working members of different sizes.

11. The abrasive cleaning device of claim 3 wherein said hinges are permanently pinned and connecting arms with clips are attached to said hinges so as to render said working members removable for replacement with substitute working members of different sizes.

12. The abrasive cleaning device of claim 5 wherein said hinges are permanently pinned and connecting arms with clips are attached to said hinges so as to render said working members removable for replacement with substitute working members of different sizes.

13. The abrasive cleaning device of claim 1, wherein said abrasive means comprises wire bristles.

14. The abrasive cleaning device of claim 1, wherein said abrasive means comprises a particulate impregnated surface.

15. The abrasive cleaning device of claim 1 wherein the rear wall has a configuration suitable for the attachment of three said working members.

* * * * *